US006929775B2

(12) United States Patent
Connors, Sr.

(10) Patent No.: US 6,929,775 B2
(45) Date of Patent: Aug. 16, 2005

(54) TUNDISH IMPACT PAD

(75) Inventor: Charles W. Connors, Sr., Wilmette, IL (US)

(73) Assignee: Magneco/Metrel, Inc., Addison, IL (US)

( * ) Notice: Subject to any disclaimer, the term of this patent is extended or adjusted under 35 U.S.C. 154(b) by 89 days.

(21) Appl. No.: 10/236,025

(22) Filed: Sep. 4, 2002

(65) Prior Publication Data

US 2004/0041312 A1 Mar. 4, 2004

(51) Int. Cl.[7] ..... B22D 41/08

(52) U.S. Cl. ..... 266/275; 222/594

(58) Field of Search ..... 222/594; 266/236, 266/275

(56) References Cited

U.S. PATENT DOCUMENTS

| | | | |
|---|---|---|---|
| 1,727,565 | A | 9/1929 | Schall |
| 2,301,880 | A | 11/1942 | Johnson, Jr. |
| 2,406,380 | A | 8/1946 | Johnson, Jr. |
| 3,887,171 | A | 6/1975 | Neuhaus |
| 4,033,546 | A | 7/1977 | Guegan |
| 4,042,229 | A | 8/1977 | Eccleston |
| 4,177,855 | A | 12/1979 | Duchateau et al. |
| 4,209,162 | A | 6/1980 | Petlau |
| 4,339,115 | A | 7/1982 | Daussan et al. |
| 4,383,570 | A | 5/1983 | White |
| 4,632,368 | A | 12/1986 | Podrini |
| 4,653,733 | A | 3/1987 | Bugalski et al. |
| 4,671,499 | A | 6/1987 | Ishiyama et al. |
| 4,711,429 | A | 12/1987 | Diederich et al. |
| 4,715,586 | A | 12/1987 | Schmidt et al. |
| 4,739,972 | A | 4/1988 | Podrini |
| 4,776,570 | A | 10/1988 | Vo Thanh et al. |
| 4,852,632 | A | 8/1989 | Jackson et al. |
| 4,909,484 | A | 3/1990 | Sutor et al. |
| 4,993,692 | A | 2/1991 | Brown et al. |
| D322,615 | S | 12/1991 | Zacharias |
| 5,072,916 | A | 12/1991 | Soofi |
| 5,110,096 | A | 5/1992 | Zacharias |
| 5,131,635 | A | 7/1992 | Soofi |
| 5,133,535 | A | 7/1992 | Soofi |
| 5,139,239 | A | 8/1992 | Eccleston |
| 5,160,480 | A | 11/1992 | Vassilicos |

(Continued)

FOREIGN PATENT DOCUMENTS

| | | |
|---|---|---|
| DE | 2643009 | 3/1978 |
| FR | 1018253 | 6/1954 |
| FR | 2132517 | 11/1972 |
| FR | 2278428 | 7/1974 |
| FR | 2314789 | 6/1977 |
| JP | 63-2539 A | 7/1988 |

OTHER PUBLICATIONS

MAGNECO/METREL Annual Report, dated Dec. 1990, 10 pages.

MAGNECO/METREL brochure titled "Tundish refractory Technology", dated Dec. 1992, 12 pages.

Roger D. Timberlake and Madjid Soofi, "Tundish Refractory Technology for Clean Steelmaking," presented at the Association of Iron and Steel Engineers Convention, Sep. 1987, 36 pages.

MAGNECO/METREL sales document entitled "Turbulence Inhibiting Impact Pads," dated 2001, showing multiple embodiments of tundish impact pads offered for sale, 5 pages.

*Primary Examiner*—Scott Kastler

(74) *Attorney, Agent, or Firm*—Brinks Hofer Gilson & Lione

(57) ABSTRACT

An impact pad formed from a refractory material for reducing the turbulence of a molten metal poured therein. The impact pad has a plurality of sidewalls, each sidewall having a plurality of spherically shaped portions. The spherically shaped portions disperse the molten metal in a variety of directions.

19 Claims, 4 Drawing Sheets

U.S. PATENT DOCUMENTS

| | | | | |
|---|---|---|---|---|
| 5,169,591 | A | | 12/1992 | Schmidt et al. |
| 5,188,796 | A | | 2/1993 | Soofi |
| 5,358,551 | A | | 10/1994 | Saylor |
| 5,518,153 | A | | 5/1996 | Zacharias et al. |
| RE35,685 | E | | 12/1997 | Schmidt et al. |
| 5,882,577 | A | | 3/1999 | Zacharias |
| 6,024,260 | A | | 2/2000 | Zacharias et al. |
| 6,156,260 | A | * | 12/2000 | Heaslip et al. ..... 266/45 |
| 6,159,418 | A | | 12/2000 | Zacharias |
| 2002/0033567 | A1 | | 3/2002 | Morales et al. |

* cited by examiner

TUNDISH IMPACT PAD

FIELD OF THE INVENTION

The present invention relates to an impact pad used in a tundish vessel of the type used in the iron and steel industry. More particularly, the present invention relates to an impact pad designed for the purpose of reducing turbulence caused by pouring molten iron or steel into the tundish vessel.

BACKGROUND OF THE INVENTION

In a tundish vessel of the type used in the iron and steel industry, there are typically variations in the purity of the molten metal contained therein. When the molten metal is in a nonagitated, nonturbulent state, impurities in the molten material tend to float to the top of the molten material causing formation of a so-called "slag" layer. In other words, the purest of the molten metal exists near the bottom of the vessel.

Molten iron or steel is poured into the tundish vessel from the top, and exits at the bottom. By maintaining a sufficient level of molten iron or steel in the vessel, and a sufficient residence time to allow impurities to float to the top, the concentration of impurities is reduced to a minimum in the lowermost portion of the vessel where the molten material leaves the vessel for further processing. Problems associated with impurities occur, however, when the pouring of molten iron or steel into the tundish from the top creates sufficient agitation and turbulence that some of the slag material is forced downward into the lowermost portion of the tundish vessel, or is prevented from rising.

Various methods and devices have been invented for the purpose of reducing turbulence in a tundish vessel caused by the pouring of molten iron or steel into the vessel. For example, U.S. Pat. No. 5,072,916 discloses the use of an impact pad or a tundish vessel sidewall having a wavy surface to reduce turbulence. While some of the prior art arrangements have been effective, there continues to be a need in the art to provide effective mechanisms for reducing the turbulence in a tundish vessel.

SUMMARY OF THE INVENTION

According to one aspect of the present invention, an impact pad for use with a tundish vessel is provided The impact pad has a plurality of sidewalls, each sidewall having a plurality of substantially spherically shaped portions. The spherically shaped portions disperse the molten metal in a variety of directions.

According to another aspect, the invention provides a combination for reducing turbulence of molten metal. The combination includes a tundish vessel and an impact pad. The tundish vessel is formed of a refractory material and is adapted to contain molten metal. The vessel includes a molten metal inlet and a molten metal outlet. The impact pad is positioned to receive molten metal from said molten metal inlet, and includes a base portion and a plurality of sidewalls extending from said base portion. Each of the sidewalls has an inward facing surface including a plurality of integrally formed flow control elements. Each flow control element has a substantially spherical surface.

Other aspects of the invention will be apparent to those skilled in the art in view of the following description.

DETAILED DESCRIPTION OF THE PREFERRED EMBODIMENTS

Figure 1:
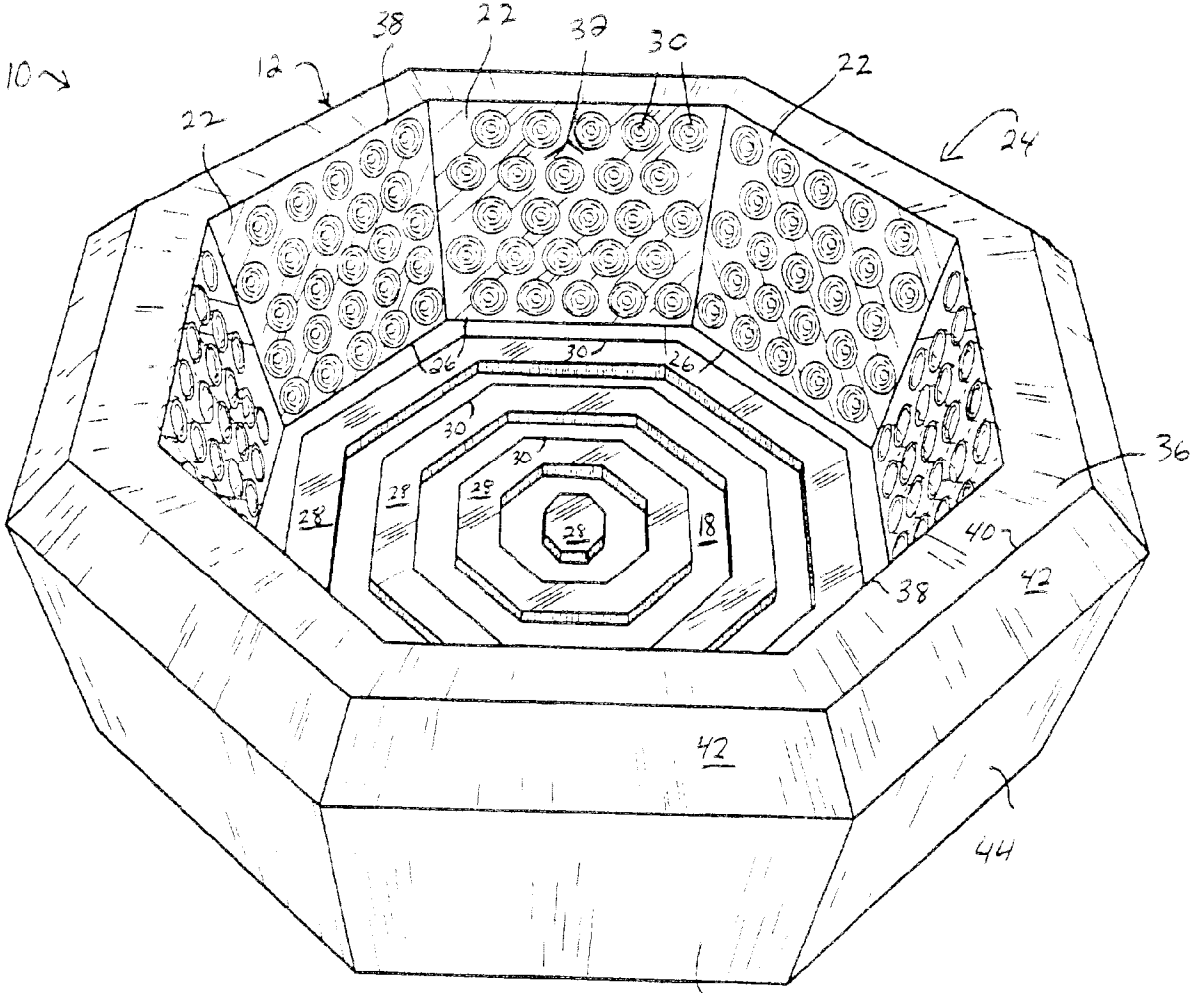
FIG. 1 is a perspective view of a tundish impact pad according to one embodiment of the present invention.
Figure 2:
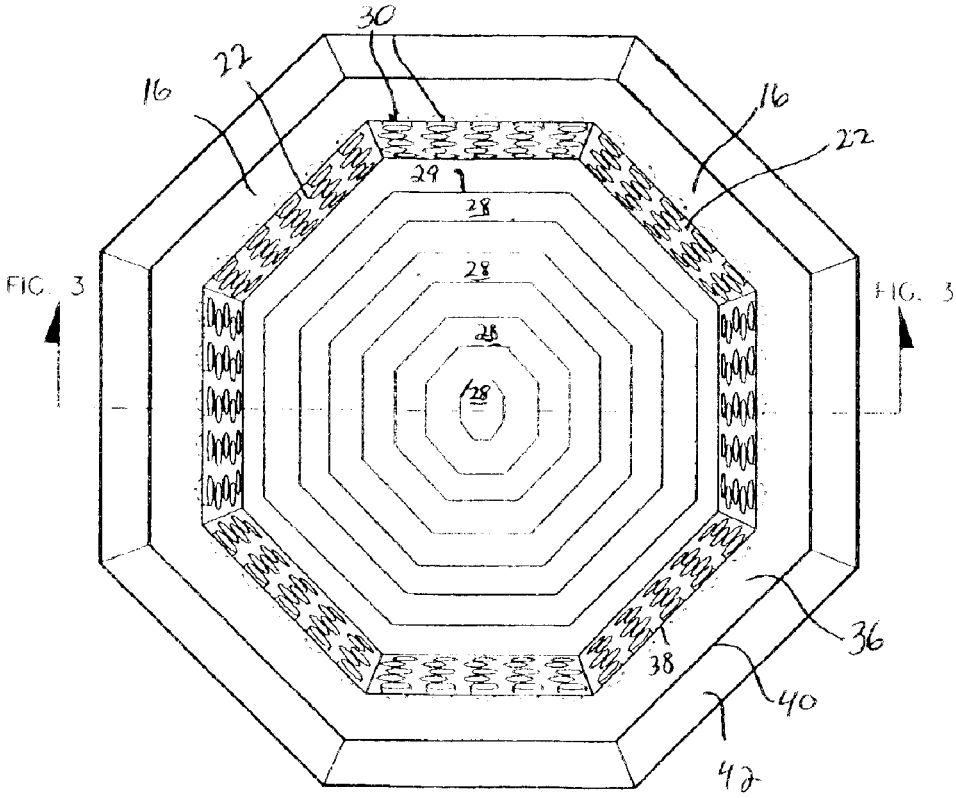
FIG. 2 is a top view of the tundish impact pad of FIG. 1.
Figure 3:
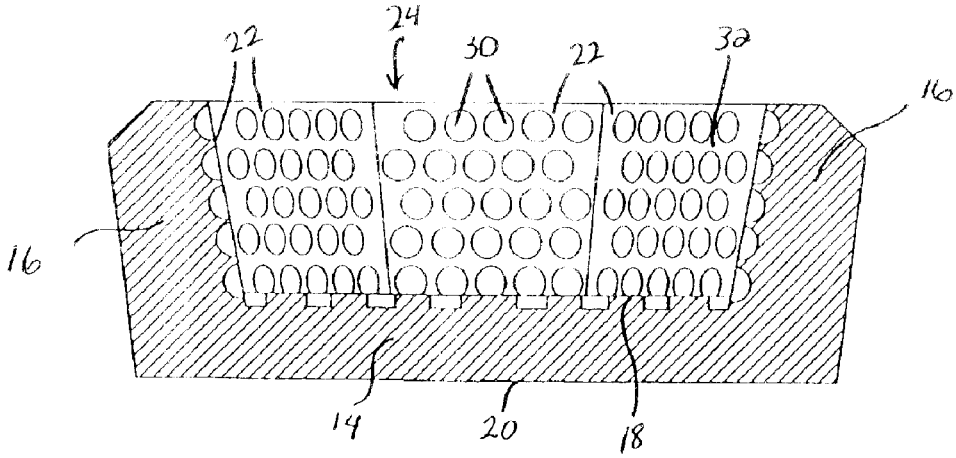
FIG. 3 is a cross-sectional view of the tundish impact pad of FIGS. 1 and 2.

Referring now to the drawings and initially to FIGS. 1–3, an impact pad according to one embodiment of the present invention is shown generally at 10. The impact pad 10 is formed as a unitary body 12 and is constructed from a high temperature-resistant refractory composition which is capable of withstanding continuous exposure to molten iron or steel at temperatures of up to 3000 degrees Fahrenheit. In one embodiment, the impact pad is constructed from a refractory material containing about 50–85 percent by weight $Al_2O_3$, 38–13 percent by weight $SiO_2$, 0.9–0.5 percent by weight CaO and 1–0.5 percent by weight $Fe_2O_3$. Other suitable refractory materials include MgO, SiC, $Cr_2O_3$, and $ZrO_2$. However, it should be recognized that the impact pad of the present invention may be manufactured from other known refractory materials, such as those using a colloidal silica binder. Any refractory material can be used, so long as the impact pad will be capable of withstanding continuous, long-term exposure to molten iron or steel.

The unitary body 12 includes a base portion 14 (FIG. 3) and a plurality of interconnected sidewalls 16. The base portion 14 includes an upper surface or floor 18 and a generally flat bottom 20 adapted for placing the impact pad 10 in a tundish vessel (as is more thoroughly described with reference to FIG. 6 below). The sidewalls 16 each have an inward facing surface 22. In the embodiment shown, the inward facing surfaces 22 extend generally upward from the floor 18 at a slightly obtuse angle. In one embodiment, the inward facing surfaces 22 extend upward from the floor 18 at an angle within the range of 10–40 degrees. The floor 18 and the inward facing surfaces together define an interior space 24.

The bottom edges 26 of the inward facing surfaces 22 of the sidewalls 16 define a periphery of the floor 18. In embodiment shown, the periphery 26 of the floor is shaped as a polygon, more particularly, an octagon. Those skilled in the art will recognize that other polygons such as triangle or other shapes may be used in accordance with the present invention.

The floor 18 of the base portion 14 is adapted to receive a flow of molten metal, and more particularly, a flow of molten metal entering a tundish vessel. The floor 18 includes islands or raised portions 28. In the embodiment shown, the raised portions 28 are shaped as concentric, continuous looped tracks of continuous height and consistent spacing from one another. The raised portions 28 have a periphery 29 that conforms substantially to the shape of the periphery 26 of the floor 18. Accordingly, in the embodiment shown in FIGS. 1–3, the peripheries 29 of the raised portions 28 are shaped as octagons. The raised portions 28 give a corrugated pattern to the floor 18 and act to slow the flow of fluid contacting the floor 18. Those skilled in the art will recognize that the raised portions 28 may be made effectively from other shapes as well.

After molten fluid impacts the floor 18, molten fluid will be forced by subsequent volumes of fluid outward towards the periphery 26 of the floor 18 and toward the inward facing surfaces 22 of the sidewalls 16. The inward facing surfaces 22 include a plurality of flow control elements 30 which function to disperse the molten metal flow and to prevent the molten fluid from becoming turbulent. In the embodiment shown, the flow control elements 30 are formed as dimples and each includes a substantially spherically shaped surface that is recessed in the inward facing surfaces 22 of the sidewalls. The phrase "substantially spherically shaped surface" means that the surface includes at least a significant portion that is spherical or nearly spherical, or forms a portion of a sphere, i.e., semi-spherical. The flow control elements 30 are shown as being placed in staggered rows. However, in alternate embodiments, the flow control elements may be placed in columns or non-staggered rows, or in other configurations. In the embodiment shown, the areas of the inward facing surfaces 22 between the flow control elements 30, i.e., the interstices 32, are substantially flat and planar throughout. In other embodiments, the interstices 32 may be curved. However, in the illustrated embodiment, the interstices are distinct from the flow control elements and do not form a continuous curve or pattern therewith.

Figure 4:
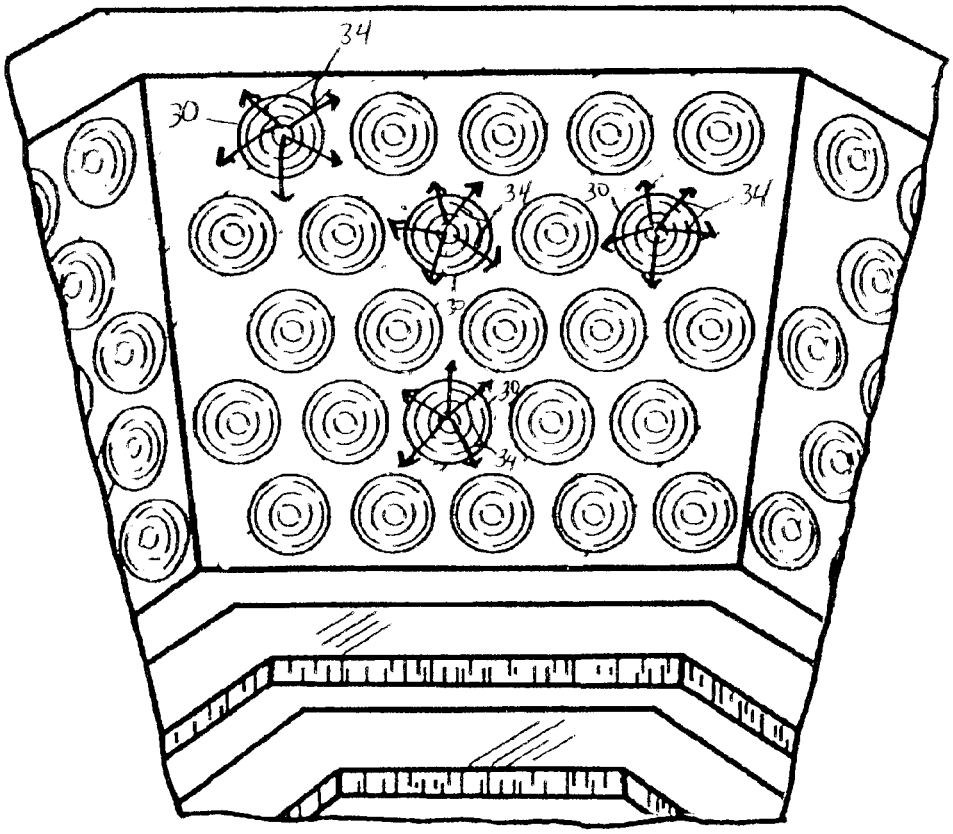
FIG. 4 is a perspective view illustrating the dispersion of molten metal by the tundish impact pad of FIG. 1.

As shown in FIG. 4, the flow control elements 30 disperse the flowing molten metal in a variety of directions as indicated by arrows 34. This dispersion prevents the flowing molten metal from becoming turbulent and causing agitation and mixing of the phases in a tundish vessel, as more fully described below. The flow control elements 30 have a diameter of about 1 cm to about 6 cm. The outer perimeters of the flow control elements may be spaced from one another by about 0.5 cm to about 4 cm. The interstices 32 typically will occupy between about 5% and about 35% of the total surface area of the inward facing surface 22 of the sidewall 16.

The impact pad 10 also includes a top surface 36 that is formed by the top portions of the sidewalls 16, and is integral to each sidewall 16. In the embodiment shown, the top surface 36 is generally planar to the floor 18. The top surface 36 includes a first edge 38 that is connected with the inward facing surfaces 22 of the sidewalls 16, and a second, opposite edge 40. The second edge 40 connects with a plurality of respective surfaces 42 defining a sloped portion. The surfaces 38 defining a sloped portion 40 are disposed at an angle to the top surface 36. The angle is opposite to that of the inward facing surfaces 22 of the sidewalls 16 to direct the flow of molten fluid which comes over the top surface 36 away from the inner space 24 of the impact pad 10. A lower outer surface 44 of the sidewalls 16 attaches the sloped portion 40 with the base portion 14. As shown, the lower outer surface 44 is angled less but generally similar to that of the inward facing surfaces 22. However, in alternate embodiments, the lower outer surface 44 of the sidewall 16 may be angled perpendicular to the bottom 20 or at another angle.

Figure 5:
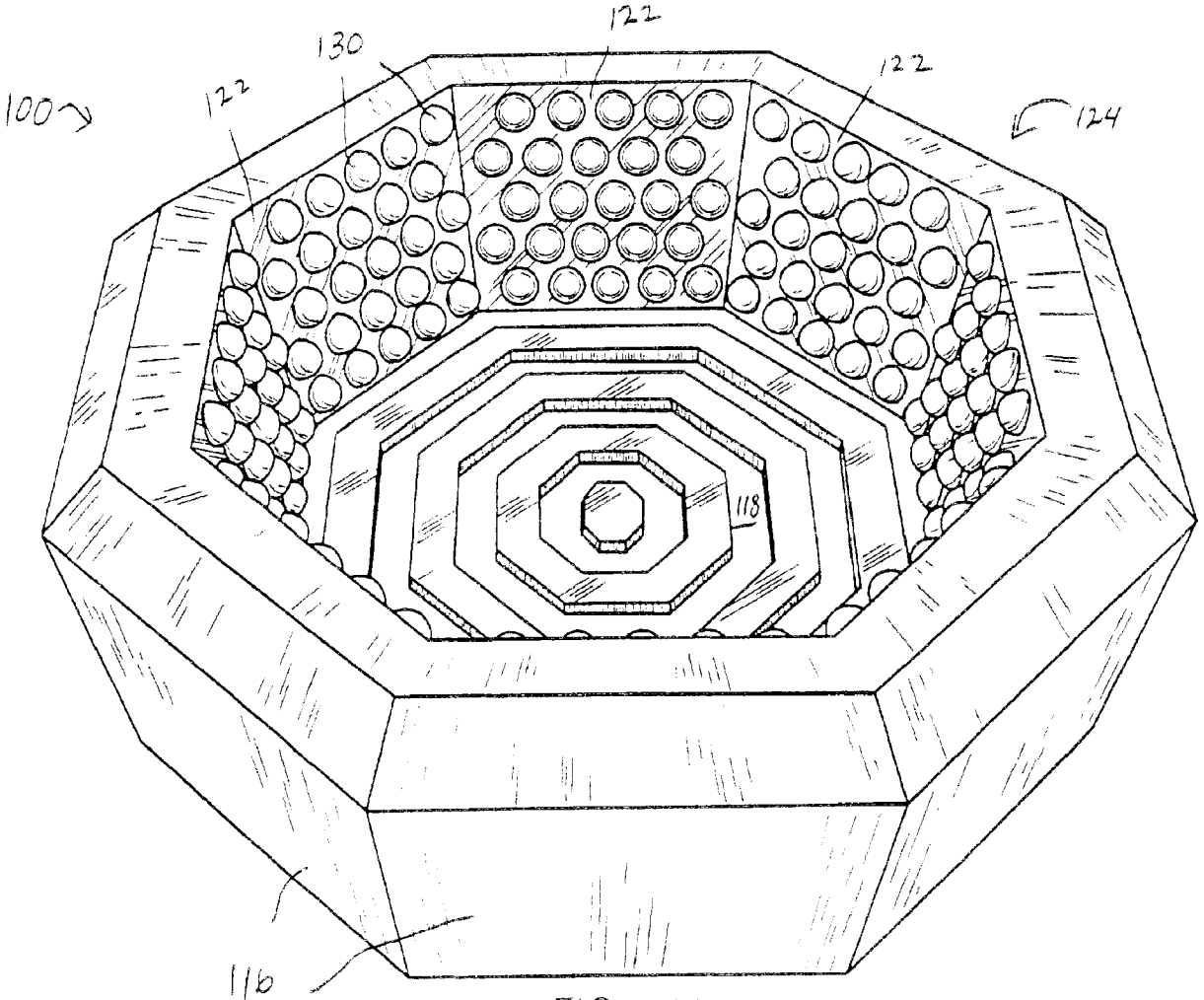
FIG. 5 is a perspective view of a tundish impact pad according to another embodiment of the invention.

FIG. 5 shows another embodiment of an impact pad according to the present invention. The impact pad 100 is similar to the pad shown in FIGS. 1–4. The impact pad 100 includes a base portion and a plurality of sidewalls 116. The base portion includes a floor 118 and each of the sidewalls 116 has an inward facing surface 122. The floor 118 and the inward facing surfaces 122 together define an inner space 124. Each inward facing surface 122 includes a plurality of flow control elements 130. The flow control elements 130 each include a substantially spherically shaped surface. However, in the embodiment of FIG. 4, the substantially spherical surface protrudes from the inward facing surfaces 122; that is, the substantially spherical surfaces extend out from the inward facing surfaces 122 and into the inner space 124 of the impact pad 110. The flow control elements 130 of FIG. 5 act to prevent turbulence in the flow of fluid coming in contact with the impact pad 110.

Although the invention has been described and illustrated with reference to specific illustrative embodiments thereof, it is not intended that the invention be limited to those illustrative embodiments. Those skilled in the art will recognize that variations and modifications can be made without departing from the true scope and spirit of the invention as defined by the claims that follow. It is therefore intended to include within the invention all such variations and modifications as fall within the scope of the appended claims and equivalents thereof.

What is claimed is:

1. An impact pad for use with a tundish vessel, comprising:

a base portion and a plurality of sidewalls extending from said base portion, the base portion and the sidewalls being formed from a refractory material, each of said sidewalls having a plurality of substantially spherically shaped portions and substantially flat interstices between the spherically shaped portions.

2. The impact pad of claim 1, wherein the spherically shaped portions have a concave shape.

3. The impact pad of claim 1, wherein the spherically shaped portions have a convex shape.

4. The impact pad of claim 1, wherein the spherically shaped portions are formed in a plurality of rows on each sidewall.

5. The impact pad of claim 4, wherein the rows are staggered.

6. The impact pad of claim 1, wherein the base portion includes a floor adapted to receive a flow of molten metal.

7. The impact pad of claim 6, wherein the floor includes a periphery, the inner surface of the sidewalls extending generally upwardly from the periphery of the floor.

8. The impact pad of claim 7, wherein the periphery forms a polygon.

9. The impact pad of claim 7, wherein the floor includes at least one raised portion.

10. The impact pad of claim 9, wherein the at least one raised portion forms a portion of a generally undulating surface.

11. The impact pad of claim 1, further comprising a top surface integral with each sidewall.

12. The impact pad of claim 11, wherein the top surface has a first edge and a second edge, the first edge connected with the sidewalls.

13. The impact pad of claim 12, further comprising a plurality of surfaces defining a sloped portion, the sloped portion attached with the second edge of the top surface and angled therefrom.

14. A combination for reducing turbulence of molten metal, comprising:

a tundish vessel formed of a refractory material and adapted to contain molten metal, the vessel including a molten metal inlet and a molten metal outlet; and an impact pad positioned to receive molten metal from said molten metal inlet, the impact pad including a base portion and a plurality of sidewalls extending from said base portion, each of said sidewalls having an inward facing surface including a plurality of integrally formed flow control elements each having a substantially spherical surface and substantially flat interstices between the flow control elements.

15. The impact pad of claim 14, wherein the spherical surface of the flow control element recesses into the inward facing surface of the sidewall.

16. The impact pad of claim 14, wherein the spherical surface of the flow control element protrudes from the surface of the sidewall.

17. The impact pad of claim 14, wherein the flow control elements are formed in a plurality of rows on each sidewall.

18. The impact pad of claim 14, wherein the rows are staggered.

19. The impact pad of claim 14, wherein the floor includes at least one raised portion.

* * * * *